US006092484A

United States Patent [19]

Babin et al.

[11] Patent Number: 6,092,484

[45] Date of Patent: Jul. 25, 2000

[54] MARINE ANCHOR SYSTEM

[76] Inventors: Hugh D. Babin, 1614 Rio Vista Ave., Houma, La. 70363; Albert J. Domangue, 4122 Bayou Estates Dr., Bourg, La. 70343

[21] Appl. No.: 09/338,575

[22] Filed: Jun. 23, 1999

[51] Int. Cl.[7] ..... B63B 21/26

[52] U.S. Cl. ..... 114/295; 114/294; 52/165

[58] Field of Search ..... 119/738, 769, 119/786, 787; 52/155, 156, 165; 114/293, 294, 295, 230.1; 135/118

[56] References Cited

U.S. PATENT DOCUMENTS

| | | | |
|---|---|---|---|
| 677,839 | 7/1901 | Young | 114/294 |
| 2,551,540 | 5/1951 | Johnson | 119/786 |
| 2,706,967 | 4/1955 | Iannetti | 119/786 |
| 2,713,327 | 7/1955 | West | 119/786 |
| 4,122,794 | 10/1978 | Rossini | 114/210 |
| 4,169,686 | 10/1979 | Balensiefen et al. . | |
| 4,241,795 | 12/1980 | Landry, Jr. . | |
| 4,697,958 | 10/1987 | Kenny, Sr. . | |
| 4,749,301 | 6/1988 | Suzuki . | |
| 4,787,601 | 11/1988 | Rybak | 256/19 |
| 4,821,159 | 4/1989 | Pike . | |
| 4,960,064 | 10/1990 | Mestas et al. | 114/230 |
| 5,127,890 | 7/1992 | Noren | 482/20 |
| 5,212,939 | 5/1993 | Pratt, Jr. . | |
| 5,613,458 | 3/1997 | Owen . | |

*Primary Examiner*—Ed Swinehart
*Attorney, Agent, or Firm*—McDermott, Will & Emery

[57] ABSTRACT

An improved anchor is provided for small boats for mooring in the bottom of bodies of water such as lakes and coastal and inland waters. Embodiments include an anchor comprising a rod, such as a round cross-section stainless steel rod about 3–6 feet long and about 1–2 inches in diameter. One end of the rod is tapered, either to a point or to a blunt or hemispherical end, while the other end has a swivel with an eyelet for connecting a shackle and a rope or chain. A hand grip is provided on the rod between the two ends of the rod. The tapered end of the rod is inserted into the bottom of a body of water using the hand grip. Thus, the anchor easily sets on the first attempt, the swivel accommodates changes in current and wind conditions that may move the boat while it is moored, thereby avoiding dislodging of the anchor, and the anchor does not snag on debris.

24 Claims, 11 Drawing Sheets

MARINE ANCHOR SYSTEM

FIELD OF THE INVENTION

The present invention relates to a boat anchor. The invention has particular applicability to anchors for relatively small boats used in lakes, coastal waters, and inland waterways.

BACKGROUND ART

The sport of boating enjoys tremendous popularity. As the sport becomes even more popular, there is a concomitant increase in demand for boating accessories. For example, relatively small boats (e.g., up to about 10–25 feet in length), used in coastal and inland waters for fishing and other forms of recreation, typically carry an anchor for mooring the boat at a desired location.

Conventional anchors for mooring boats in lakes, coastal waters and inland waters having a depth of about 0 to about 20 feet and soft bottoms, such as mud or sand, are shown in FIGS. 1A–1C. They include mushroom anchors (FIG. 1A), grapnel anchors (FIG. 1B) and navy anchors (FIG. 1C). These anchors are typically attached to the boat with a rope or chain, such as a nylon rope. In use, after the boat is brought to a desired location, the anchor is lowered into the water on the rope until it reaches the bottom, and the rope is tugged at an angle to the bottom, causing the anchor to dig into the bottom and thereby "set", preventing the boat from drifting in the water.

Conventional anchors have several disadvantages. They are typically difficult to set properly, requiring the operator of the boat to attempt to set the anchor several times before succeeding, meanwhile allowing the boat to drift away from the desired mooring location (e.g., a school of fish). Moreover, the anchor may be dislodged from the bottom if the boat is moved by wind or current. When retrieved from the bottom of a body of water, conventional anchors typically carry mud, grass or other debris up with them, which is likely to be deposited in the boat. This is inconvenient in that the debris must be cleaned from the boat, and may cause damage to the boat or to items inside the boat. Furthermore, conventional anchors tend to be noisy when being deployed, thereby frightening away fish. Still further, conventional anchors are typically bulky and consequently difficult to store when not in use, thus taking up valuable space inside the boat.

There exists a need for a boat anchor that sets easily and remains set despite currents and winds. There exists a further need for a boat anchor that is convenient to store, and does not retain debris when retrieved.

SUMMARY OF THE INVENTION

An advantage of the present invention is a boat anchor for use in lakes and inland and coastal bodies of water that sets on the first attempt, and accommodates changes in wind and currents. A further advantage of the present invention is a boat anchor that does not snag and retain debris when retrieved. A still further advantage of the present invention is a boat anchor that is easily and conveniently stored in a boat.

According to the present invention, the foregoing and other advantages are achieved, in part, by a boat anchor comprising an elongated rod having a tapered portion at a first distal end, and a swivel cap mounted at a second distal end to allow rotation of the swivel cap about a longitudinal axis of the rod. The swivel cap has an eyelet for attaching a shackle for a rope. A hand grip is provided on the rod between the first and second distal ends for facilitating insertion of the rod into the bottom of a body of water.

Additional advantages of the present invention will become readily apparent to those skilled in this art from the following detailed description, wherein only preferred embodiments of the present invention are shown and described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF PREFERRED EMBODIMENTS

Conventional boat anchors are bulky and hard to store on the boat, and retain and deposit debris in the boat when retrieved. Additionally, conventional anchors are difficult to set in soft bottoms of bodies of water, and do not adapt to changing currents and wind conditions that move the boat when the anchor is deployed. The present invention addresses and solves these and other problems stemming from conventional anchors.

According to the present invention, a boat anchor is provided comprising a rod, such as a round cross-section stainless steel rod about 3–6 feet long and about ¾ inch to about 2 inches in diameter. One end of the rod is tapered, either to a point or to a blunt or hemispherical end, while the other end has an eyelet, optionally a swivel with an eyelet, for connecting a shackle and a rope or chain. A hand grip is provided on the rod between the two ends of the rod.

To deploy the inventive anchor, the user inserts the tapered end of the rod into the soft bottom of a body of water using the hand grip, and connects the shackle and the rope to the eyelet. Optionally, the anchor may be deployed into the bottom of a body of water, such as a lake, by throwing it into the water, as close to perpendicular to the water surface as possible, in a manner that a javelin or spear is thrown. The anchor of the present invention easily sets on the first attempt, thereby avoiding drifting of the boat. The swivel accommodates changes in current and wind conditions that may move the boat while it is moored, thereby avoiding dislodging of the anchor. Furthermore, the inventive anchor does not snag on debris, and so comes out of the water free of debris that fouls the inside of the boat. Still further, the inventive anchor is easily mounted out of the way on board the boat, such as inside a cylindrical fishing rod holder or in brackets or clamps attached to the inside walls of the boat.

Figure 1A:
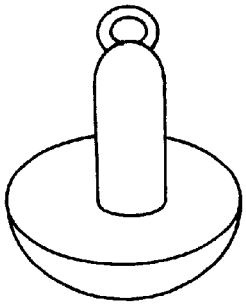
FIG. 1A PRIOR ART
FIGS. 1A–1C illustrate conventional boat anchors.
Figure 1B:
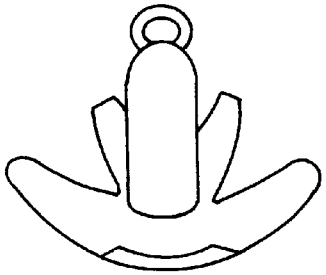
FIG. 1B PRIOR ART
Figure 1C:
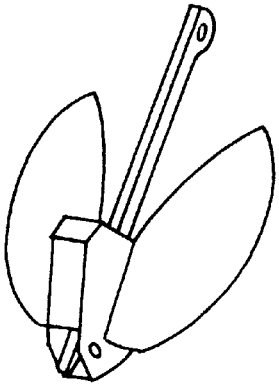
FIG. 1C PRIOR ART
Figure 2A:
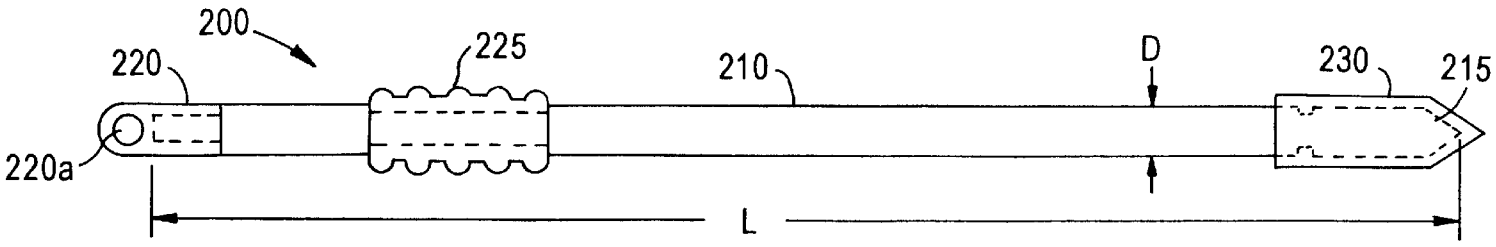
FIG. 2A is a side view of an anchor according to an embodiment of the present invention.

An embodiment of the present invention is shown in FIGS. 2A–3B. Referring now to FIGS. 2A and 2B, a boat anchor 200 according to this embodiment of the present invention comprises an elongated rod 210, such as a stainless steel rod with a circular cross-section having a length L of about 3 feet to about 6 feet and a diameter D of about ¾ inch to about 2 inches. Stainless steel is a preferred material for rod 210 because of its anti-corrosive properties. However, any material or combination of materials may be used which provides the strength and weight necessary for the function of the inventive anchor. Length L and diameter D are determined by the size of the boat with which anchor 200 is to be used. For example, an inventive anchor 200 having a length L of about 4 feet and a diameter D of about ¾ inch would be appropriate for a boat having a length of 16 feet or less. A larger boat of about 16–25 feet in length would require anchor 200 to have a length L of about 5 feet and diameter D of about 1–2 inches for best results.

Figure 2B:
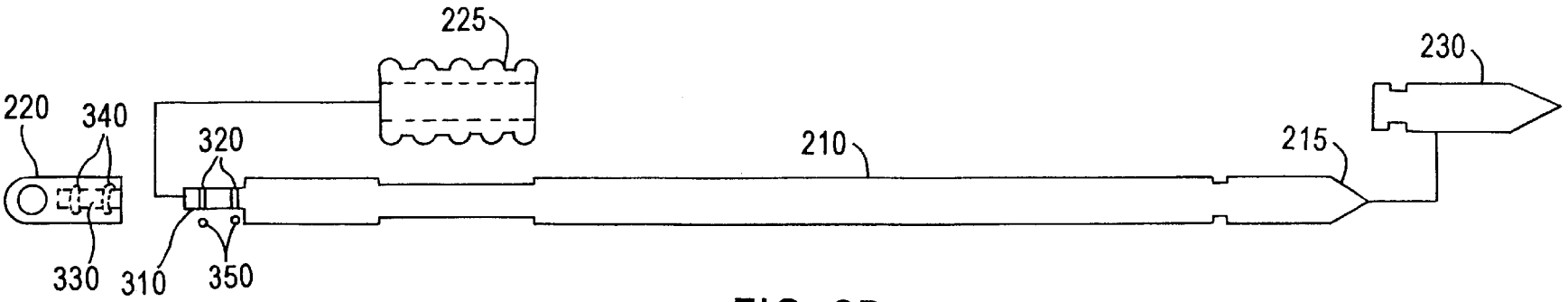
FIG. 2B is an exploded view of the anchor of FIG. 2A.
Figure 4A:
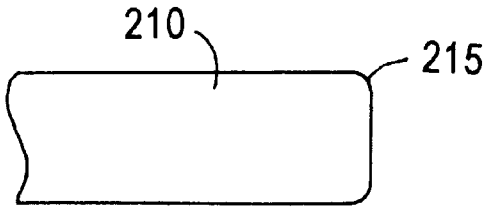
FIG. 4A and 4B are partial side views of anchors according to other embodiments of the present invention.
Figure 4B:
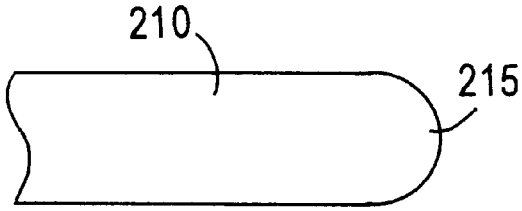

Rod 210 has a tapered portion 215 at one distal end. Tapered portion 215 is pointed, as shown in FIGS. 2A and 2B, or in alternative embodiments can be blunt, as shown in FIG. 4A, or semicircular, as shown in FIG. 4B, depending on the type of bottom of the body of water in which anchor 200 is to be used. A pointed taper as shown in FIGS. 2A–2B is best suited for a sand or mud bottom, while a blunt or hemispherical bottom as shown in FIGS. 4A–4B is suitable for a softer bottom. A protective cap 230 that fits over tapered end 215 prevents injury to the user and damage to the boat when anchor 200 is not in use.

Figure 4C:
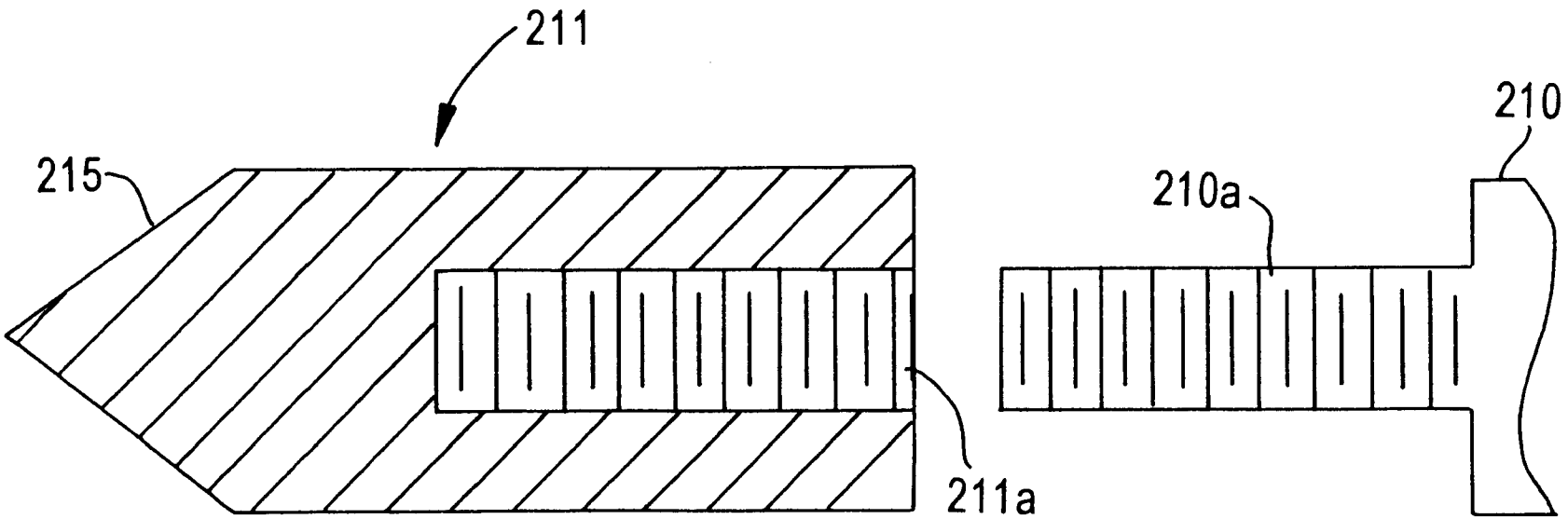
FIG. 4C is a partial cross-sectional view of an anchor according to an embodiment of the present invention.

In an alternative embodiment of the invention, illustrated in FIG. 4C, rod 210 has a removable end piece 211 that includes tapered end 215. Rod end piece 211 has a threaded cylindrical cavity 211*a* for threading into a threaded portion 210*a* of rod 210 for retaining rod end piece 211 to rod 210. Rod end piece 211 is made of a tough, resilient, corrosion-resistant material such as stainless steel, polytetrafluoroethylene (PTFE or Teflon™) or another material with properties similar to PTFE. Rod end piece 211 is easily removable and replaceable if damaged or worn by rocks, shells, or other hard matter when the anchor is in use.

Figure 5:
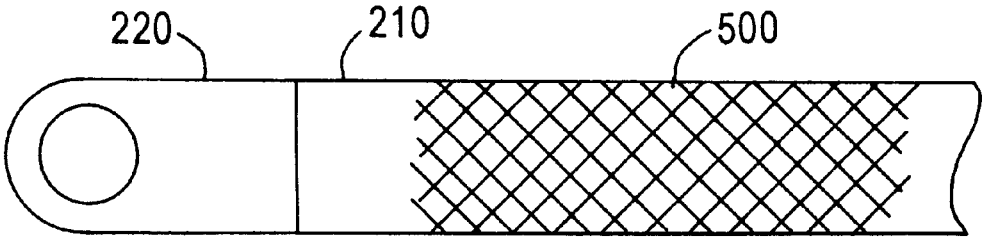
FIG. 5 is a partial side view of an anchor according to an embodiment of the present invention.

Rod 210 has a swivel cap 220, preferably of stainless steel, mounted to its other distal end, which rotates about a longitudinal axis of rod 210, and has an eyelet 220*a* which is engageable with a shackle (not shown) for connecting a rope, chain or cable (not shown) to anchor 200. A hand grip 225 is provided between tapered end 215 and swivel cap 220 for facilitating insertion of rod 210 into the bottom of the body of water. Hand grip 225 preferably comprises a resilient material, such as rubber. In an alternative embodiment of the present invention, as shown in FIG. 5, hand grip 225 comprises a knurled portion 500 of rod 210.

Figure 3A:
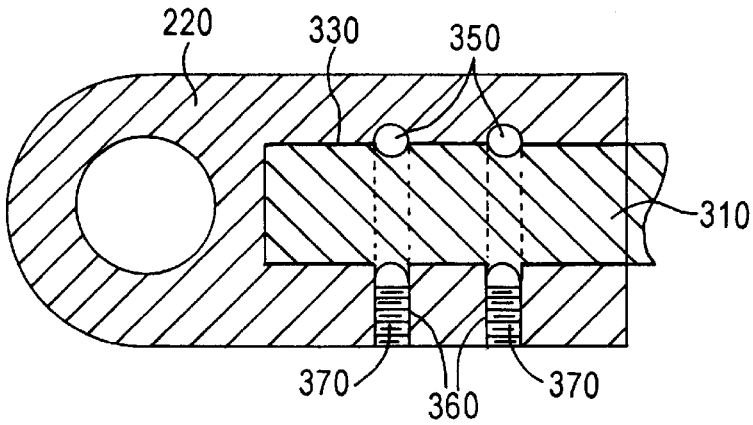
FIG. 3A is a cross-sectional view of an anchor according to an embodiment of the present invention.
Figure 3B:
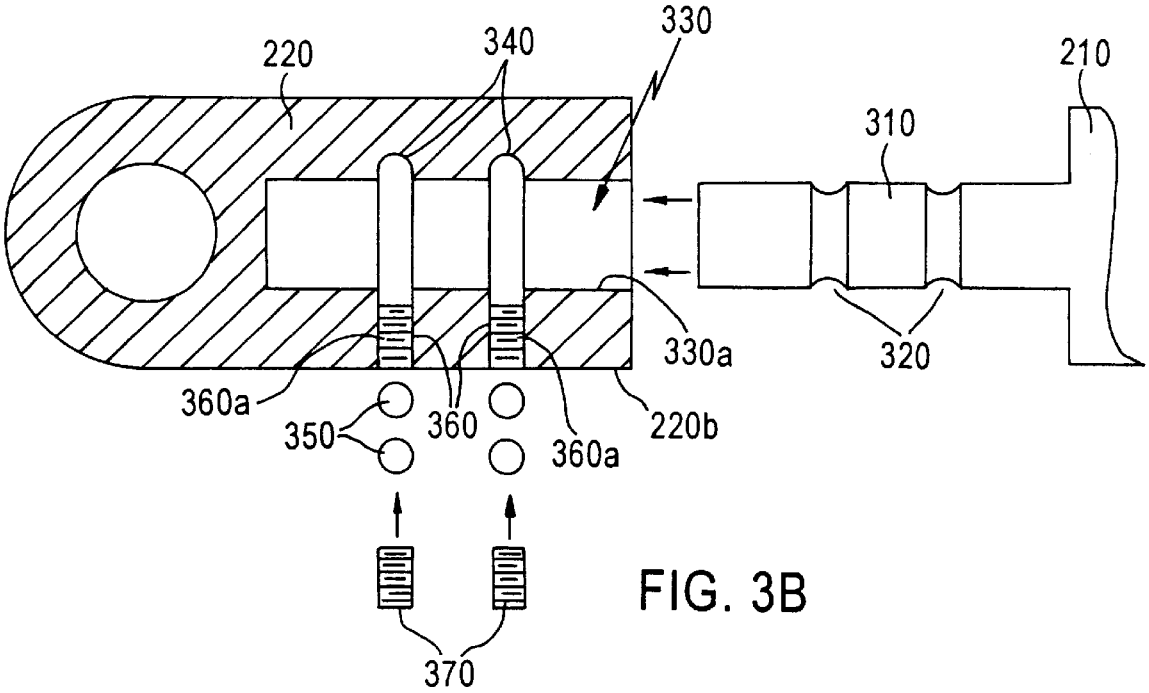
FIG. 3B is a partial cross-sectional view of the anchor of FIG. 3A.

Referring now to FIGS. 2B, 3A and 3B, rod 210 has a portion 310 with a circular cross section at one distal end, and swivel cap 220 has a cylindrical cavity 330 for fitting over circular portion 310. Circular portion 310 has circumferential grooves 320, which are approximately semicircular, and the wall 330*a* of cavity 330 comprises approximately semicircular grooves 340. Grooves 320 and 340 cooperate to provide a race for a plurality of ball bearings 350 which retain swivel cap 220 on rod 210 and allow rotation of swivel cap 220 relative to rod 210. Ball bearings 350 are preferably about ¼ inch to about ⅜ inch in diameter. Swivel cap 220 has through-holes 360 extending from its outer surface 220*b* and communicating with grooves 340 for allowing insertion of ball bearings 350 into grooves 320, 340. Plugs 370 retain ball bearings in grooves 320, 340 after insertion. Plugs 370 are preferably threaded fasteners, such as Allen head set screws, which engage threads 360*a* in through-holes 360.

Figure 6A:
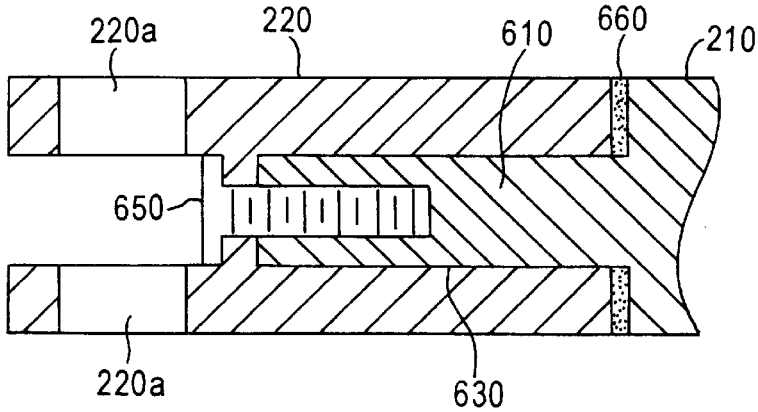
FIG. 6A and 6B are cross-sectional views of an anchor according to an embodiment of the present invention.
Figure 6B:
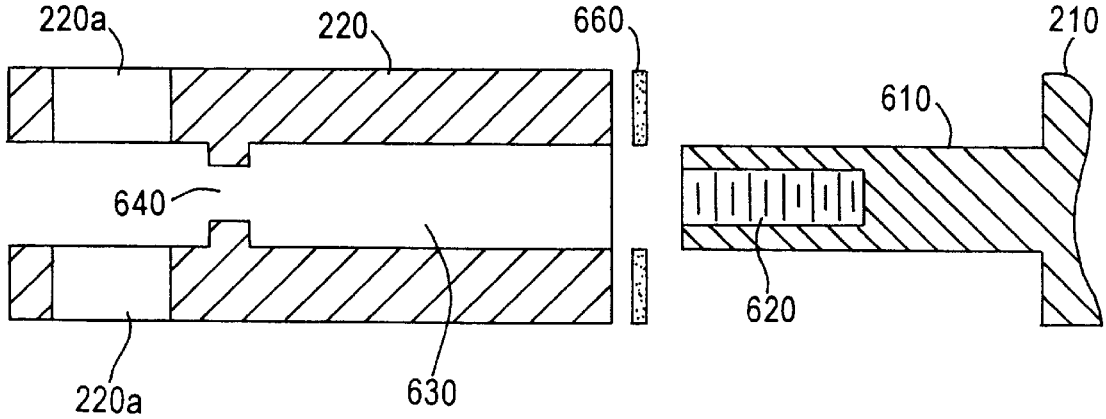

In an alternative embodiment of the invention, as shown in FIGS. 6A and 6B, rod 210 has a portion 610 with a circular cross section at one distal end and a threaded hole 620 extending into rod 210 longitudinally. Swivel cap 220 has a cylindrical cavity 630 for fitting over circular portion 610, and a through-hole 640 that communicates with threaded hole 620 in rod 210. A bolt 650 extends through through-hole 640 into threaded hole 620 to retain swivel cap 220 to rod 210 while allowing rotation of swivel cap 220 relative to rod 210. A washer 660, such as a teflon washer, provides a low-friction bearing surface between swivel cap 220 and rod 210.

Figure 7:
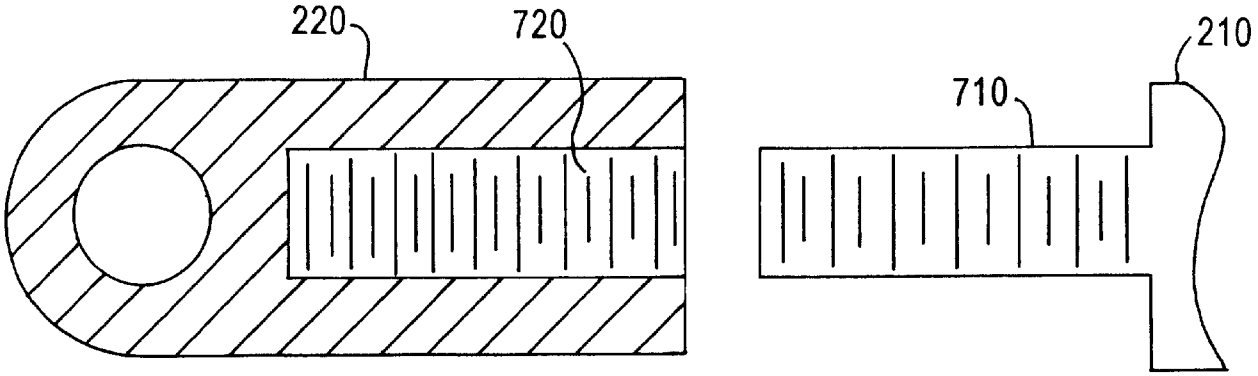
FIG. 7 is a partial cross-sectional view of an anchor according to an embodiment of the present invention.

In another alternative embodiment of the present invention, as illustrated in FIG. 7, rod 210 has a threaded portion 710 at one distal end, and swivel cap 220 has a threaded cylindrical cavity 720 for threading into threaded portion 710 for retaining swivel cap 220 to rod 210 and for allowing rotation of swivel cap 220 relative to rod 210.

Figure 8:
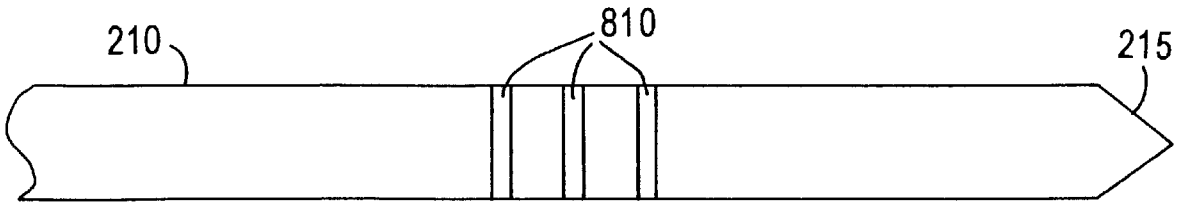
FIGS. 8, 9, 10A, 10B and 11 are partial side views of anchors according to embodiments of the present invention.
Figure 9:
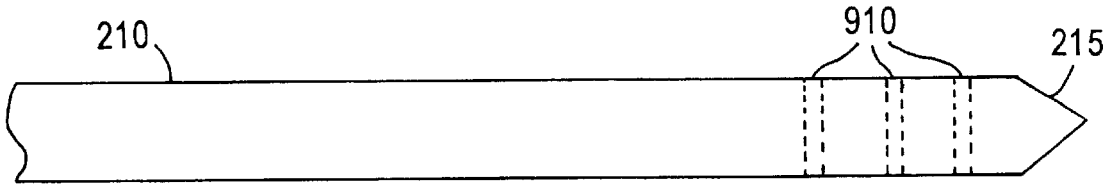

In other embodiments of the present invention, rod 210 has features to facilitate setting anchor 200 in the bottom of a body of water. As shown in FIG. 8, rod 210 can have a plurality of circumferential grooves 810 about 12 inches from the end of rod 210. Alternatively, rod 210 can be provided with a plurality of through-holes 910 near its distal end having a diameter of about ⅜ inches or less for allowing the passing the passage of particles such as mud or sand.

Figure 10A:
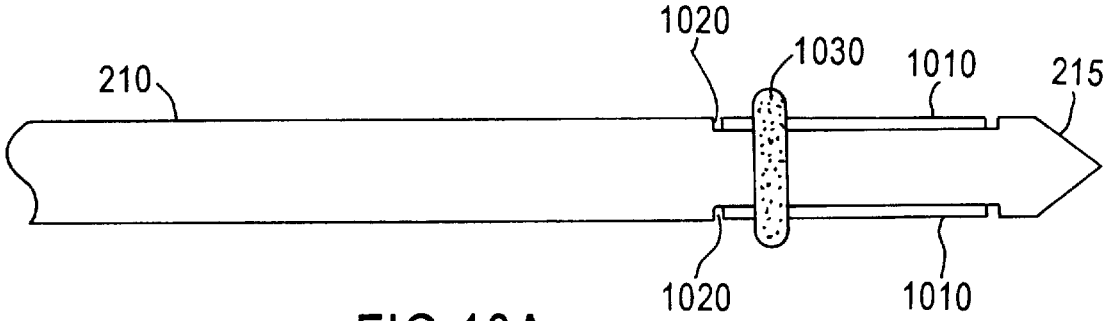
Figure 10B:
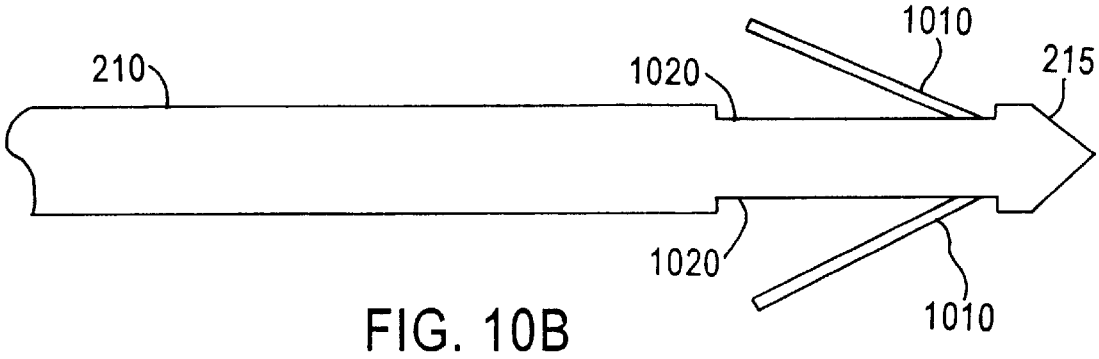

Another alternative embodiment of the present invention is shown in FIGS. 10A and 10B, wherein rod 210 has a plurality of prongs 1010 near one distal end which move from a retracted position (FIG. 10A) in grooves 1020 flush with the outer surface of rod 210 to an extended position (FIG. 10B) protruding from rod 210. Prongs 1010 are held in the retracted position, for example, by a rubber O-ring 1030 until anchor 200 is inserted into the bottom of the body of water. Then, a slight upward pull on anchor 200 moves O-ring 1030 and allows prongs 1010 to open, thereby aiding the anchor's set.

Figure 11:
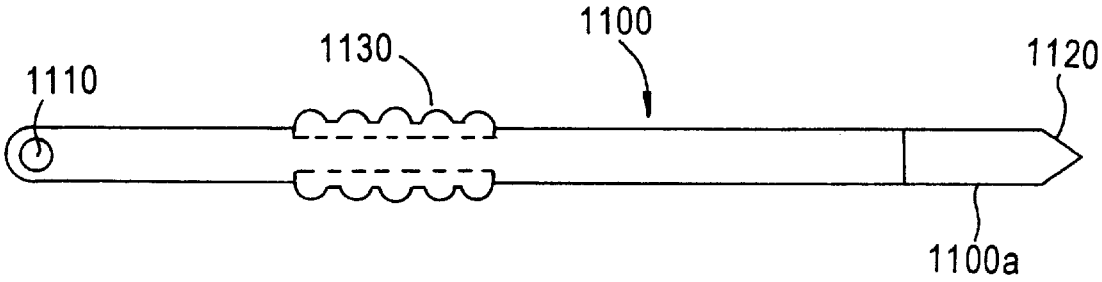

In still another embodiment of the present invention, as shown in FIG. 11, the swivel cap is eliminated, and an eyelet 1110 for connecting a shackle (not shown) is provided near a distal end of a rod 1100 having a circular cross-section and a tapered end 1120. As in the other embodiments of the present invention described above, a hand grip 1130 is provided between tapered end 1120 and eyelet 1110, rod 1100 can have a removable end piece 100*a* comprising tapered end 1120, and tapered end 1120 can be pointed, blunt or hemispherical. The anchor of this embodiment is economical to produce, and since rod 1100 has a circular cross-section, it is able to accommodate current and wind changes that cause the boat to move without dislodging from the bottom.

Figure 12A:
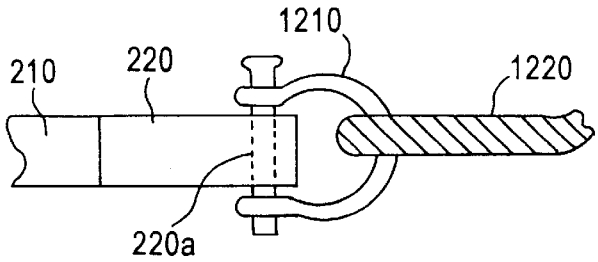
FIGS. 12A and 12B illustrate an anchor of the present invention in use.
Figure 12B:
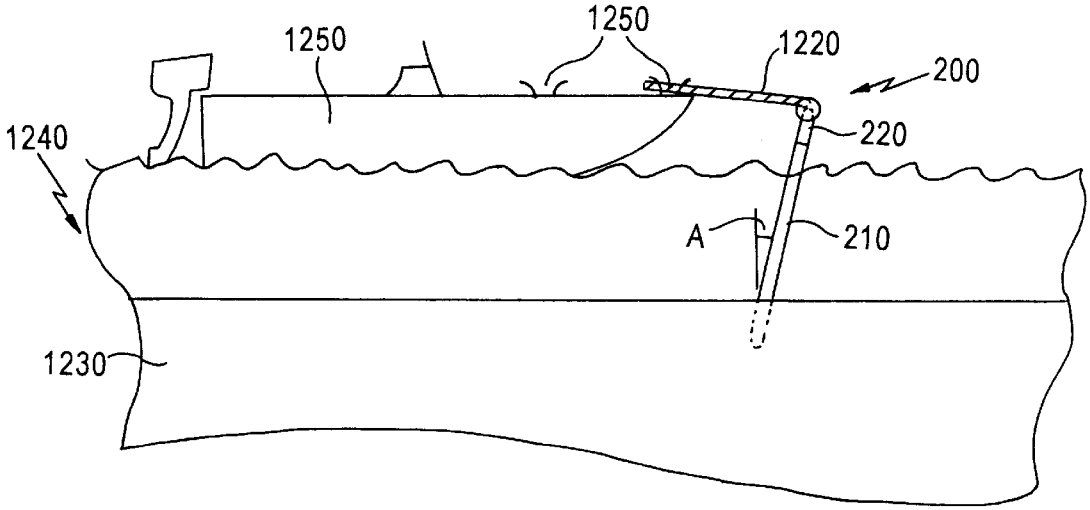

FIGS. 12A and 12B illustrate the inventive anchor of FIG. 2A in use. FIG. 12A shows eyelet 220*a* of swivel cap 220 engaged with a shackle 1210, which is in turn attached to a rope 1220, such as a ⅜ inch or ½ inch nylon rope. FIG. 12B shows anchor 200 inserted by hand and set in the bottom 1230, such as mud or sand, of a body of water 1240. Rope 1220 typically attaches to a cleat 1250 of the boat 1260. Anchor 200 should be inserted in bottom 1230 at an acute angle A of about 30° to about 40° to ensure a proper set. Once properly set, swivel cap 220 allows boat 1260 to move in reaction to changes in wind or current without dislodging anchor 200 or snagging rope 1220.

Figure 13:
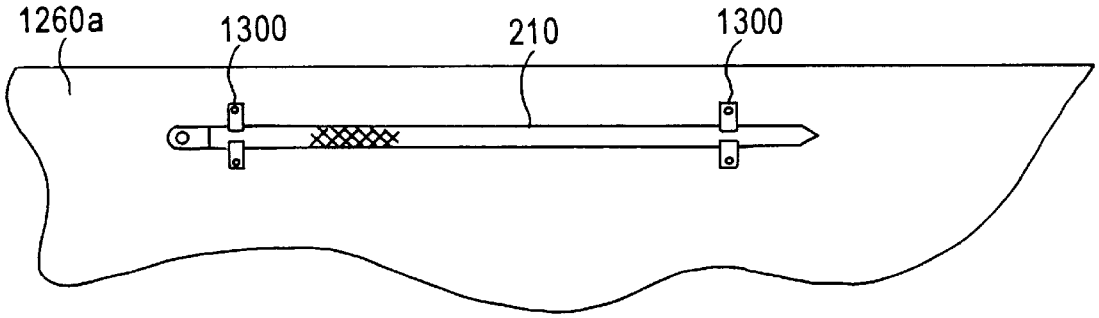
FIG. 13 illustrates storage of an anchor according to the present invention.

FIG. 13 illustrates a way of storing anchor 200 when not in use, wherein clamps 1300, which may comprise metal or a resilient material such as rubber, are employed to hold rod 210 on a side 1260*a* of boat 1260. Alternatively, anchor 200 can be easily stored in a fishing rod holder (not shown) on boat 1260, or can be attached to cleats 1250.

Thus, the inventive anchor has many advantages over conventional boat anchors. The anchor of the present invention easily sets on the first attempt due to its elongated shape and hand grip, thereby avoiding drifting of the boat during setting attempts. The swivel cap accommodates changes in current and wind conditions that may move the boat while it is moored, thereby avoiding dislodging of the anchor. Furthermore, the inventive anchor does not snag on debris, and is therefore clean upon retrieval. Still further, it is easily mounted out of the way on board the boat, such as inside a cylindrical fishing rod holder or in brackets or clamps easily attached to the walls of the boat.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A boat anchor comprising:

an elongated rod having a tapered portion at a first distal end;

a swivel cap mounted at a second distal end of the rod to allow rotation of the swivel cap about a longitudinal axis of the rod, the swivel cap having an eyelet; and a fixed hand grip on the rod between the first and second distal ends for facilitating insertion of the rod into the bottom of a body of water.

2. The boat anchor of claim 1, wherein the hand grip comprises a resilient material.

3. The boat anchor of claim 1, wherein the hand grip comprises a knurled portion of the rod.

4. The boat anchor of claim 1, wherein the rod and the swivel cap comprise stainless steel.

5. The boat anchor of claim 1, wherein the eyelet is engageable with a shackle for connecting a rope, chain or cable to the anchor.

6. The boat anchor of claim 1, wherein the tapered portion of the rod is pointed, blunt or hemispherical at the first distal end.

7. The boat anchor of claim 1, comprising a plurality of through-holes near the first distal end of the rod for allowing the passage of particles through the holes for facilitating setting the anchor in the bottom of a body of water.

8. The boat anchor of claim 7, wherein the holes have a diameter of about ⅜ inch or less.

9. The boat anchor of claim 1, comprising a plurality of prongs near the first distal end of the rod movable from a retracted position flush with an outer surface of the rod to an extended position protruding from the rod for facilitating setting the anchor in the bottom of a body of water.

10. The boat anchor of claim 1, wherein the rod has a threaded portion at the second distal end, and the swivel cap has a threaded cylindrical cavity for threading onto the threaded portion of the rod to allow the rotation of the swivel cap.

11. The boat anchor of claim 1, further comprising a protective cap for the tapered end of the rod.

12. The boat anchor of claim 1, further comprising means engageable with the rod for securing the anchor to the inside of a boat when the anchor is not in use.

13. The boat anchor of claim 1, wherein the tapered portion comprises a removable end piece.

14. The boat anchor of claim 13, wherein the removable end piece comprises PTFE.

15. The boat anchor of claim 13, wherein the rod has a threaded portion at the first distal end, and the removable end piece has a threaded cylindrical cavity for threading onto the threaded portion at the first distal end of the rod to retain the removable end piece on the rod.

16. A boat anchor comprising:

an elongated rod having a tapered portion at a first distal end; and a swivel cap mounted at a second distal end of the rod to allow rotation of the swivel cap about a longitudinal axis of the rod, the swivel cap having an eyelet;

wherein the rod has a portion with a circular cross-section proximal to the second distal end and the swivel cap has a cylindrical cavity for fitting over the circular cross-sectional portion of the rod, the anchor further comprising:

a first groove in the circumference of the circular cross-sectional portion of the rod;

a plurality of ball bearings insertable into the first groove; and a second groove, in the wall of the cylindrical cavity, for cooperating with the first groove to retain the ball bearings, retain the swivel cap on the rod, and allow the rotation of the swivel cap.

17. The boat anchor of claim 16, further comprising:

a through-hole in the swivel cap extending from an outer surface of the swivel cap and communicating with the second groove for allowing insertion of the ball bearings into the first and second grooves; and a plug engageable with the through-hole for preventing the ball bearings from re-entering the through-hole after insertion in the grooves.

18. The boat anchor of claim 17, wherein the through-hole is threaded, and the plug comprises a screw threadable into the threads of the through-hole.

19. A boat anchor comprising:

an elongated rod having a tapered portion at a first distal end; and a swivel cap mounted at a second distal end of the rod to allow rotation of the swivel cap about a longitudinal axis of the rod, the swivel cap having an eyelet, wherein the rod has a length of about 3 feet to about 6 feet; and wherein the rod has a circular cross-section and a diameter of about ¾ inch to about 2 inches.

20. The boat anchor of claim 19, comprising a plurality of circumferential grooves in the rod about 12 inches from the first distal end for facilitating setting of the soft bottom of a body of water.

21. A boat anchor comprising:

an elongated rod having a tapered portion at a first distal end; and a swivel cap mounted at a second distal end of the rod to allow rotation of the swivel cap about a longitudinal axis of the rod, the swivel cap having an eyelet;

wherein the rod has a portion with a circular cross-section at the second distal end and a threaded hole extending from the second distal end along a longitudinal axis of the rod;

wherein the swivel cap has a cylindrical cavity for fitting over the circular cross-sectional portion of the rod and a through-hole extending from an outer surface of the swivel cap and communicating with the threaded hole; and wherein the anchor further comprises a bolt extendable through the through-hole and threadable into the threaded hole for retaining the swivel cap to the rod while allowing the rotation of the swivel cap.

22. A boat anchor comprising an elongated rod having a tapered portion at a first distal end, an eyelet at a second distal end, and a fixed hand grip on the rod between the first and second distal ends for facilitating insertion of the rod into the bottom of a body of water, the eyelet being engageable with a shackle for connecting a rope, chain or cable to the anchor.

23. The boat anchor of claim 22, wherein the tapered portion of the rod is pointed, blunt or hemispherical at the first distal end.

24. The boat anchor of claim 22, wherein the tapered portion comprises a removable end piece.

* * * * *